US009065184B2

(12) United States Patent
Ilnar et al.

(10) Patent No.: US 9,065,184 B2
(45) Date of Patent: Jun. 23, 2015

(54) N-PORT FEEDING SYSTEM HAVING A STRUCTURE IN WHICH PATTERNS ARE DIVIDED WITH IN PARALLEL AND FEEDING ELEMENT INCLUDED IN THE SAME

(71) Applicant: ACE TECHNOLOGIES CORPORATION, Incheon (KR)

(72) Inventors: Battarov Ilnar, Incheon (KR); Min-Seok Jung, Gyeonggi-Do (KR); Ho-Yong Kim, Incheon (KR); Chul-Keun Park, Gyeonggi-Do (KR); Jin-Ho Kim, Incheon (KR)

(73) Assignee: ACE Technologies Corporation, Incheon (KR)

( * ) Notice: Subject to any disclaimer, the term of this patent is extended or adjusted under 35 U.S.C. 154(b) by 222 days.

(21) Appl. No.: 13/768,371

(22) Filed: Feb. 15, 2013

(65) Prior Publication Data

US 2013/0154893 A1 Jun. 20, 2013

Related U.S. Application Data

(63) Continuation of application No. PCT/KR2011/006100, filed on Aug. 18, 2011.

(30) Foreign Application Priority Data

Aug. 19, 2010 (KR) ..... 10-2010-0080487

(51) Int. Cl.
*H01Q 1/24* (2006.01)
*H01Q 21/00* (2006.01)
(Continued)

(52) U.S. Cl.
CPC ..... *H01Q 21/0075* (2013.01); *H01P 5/12* (2013.01); *H01Q 3/32* (2013.01); *H01P 1/00* (2013.01); *H01P 1/184* (2013.01); *H01Q 21/061* (2013.01)

(58) Field of Classification Search
CPC ..... H01P 1/184; H01P 5/12; H01Q 21/0075
USPC ..... 343/700 MS, 853
See application file for complete search history.

(56) References Cited

U.S. PATENT DOCUMENTS

| | | | | |
|---|---|---|---|---|
| 4,335,385 | A * | 6/1982 | Hall | 343/700 MS |
| 5,087,920 | A * | 2/1992 | Tsurumaru et al. | 343/700 MS |
| 5,864,127 | A * | 1/1999 | Jackson et al. | 235/454 |
| 6,650,290 | B1 | 11/2003 | Chang et al. | |
| 7,224,246 | B2 | 5/2007 | Thomas | |

(Continued)

FOREIGN PATENT DOCUMENTS

| | | | |
|---|---|---|---|
| JP | 09-307338 | A | 11/1997 |
| WO | 0120720 | A1 | 3/2001 |

*Primary Examiner* — Tho G Phan
(74) *Attorney, Agent, or Firm* — Mintz Levin Cohn Ferris Glovsky and Popeo, P.C.; Kongsik Kim; Jonathon P. Western

(57) ABSTRACT

A feeding system is provided, and it supplies a power using conductive patterns divided into pattern groups, e.g. patterns having U shape. The feeding system includes a first substrate, first patterns disposed on the first substrate, second patterns disposed on the first substrate, and connected electrically in parallel to the first patterns, a second substrate spaced from the first substrate, at least one third pattern disposed on the second substrate, and configured to correspond to the first patterns and one or more fourth pattern disposed on the second substrate, and configured to correspond to the second patterns. Here, the third pattern connects electrically corresponding first patterns, and the fourth pattern connects electrically corresponding second patterns.

14 Claims, 14 Drawing Sheets

(51) Int. Cl.

| | |
|---|---|
| ***H01P 5/12*** | (2006.01) |
| ***H01Q 3/32*** | (2006.01) |
| ***H01P 1/00*** | (2006.01) |
| ***H01P 1/18*** | (2006.01) |
| ***H01Q 21/06*** | (2006.01) |

(56) References Cited

U.S. PATENT DOCUMENTS

| | | | | |
|---|---|---|---|---|
| 2009/0179815 | A1* | 7/2009 | Sotoma et al. | 343/833 |
| 2011/0133992 | A1* | 6/2011 | Suzuki | 343/700 MS |

* cited by examiner

RELATED ART

N-PORT FEEDING SYSTEM HAVING A STRUCTURE IN WHICH PATTERNS ARE DIVIDED WITH IN PARALLEL AND FEEDING ELEMENT INCLUDED IN THE SAME

CROSS-REFERENCE TO RELATED APPLICATIONS

This is a continuation of International Application No. PCT/KR2011/006100 filed on Aug. 18, 2011, which claims priority to Korean Application No. 10-2010-0080487 filed on Aug. 19, 2010, which applications are incorporated herein by reference.

TECHNICAL FIELD

Example embodiment of the present invention relates to a feeding system and a feeding element included in the same, more particularly relates to a feeding system for feeding a power using conductive patterns, e.g. U shape patterns which are divided in parallel and a feeding element included in the same.

BACKGROUND ART

A feeding system supplies a power inputted from an external source to another device through its output terminal, and may be for example a phase shifter used in an antenna shown in following FIG. 1.

FIG. 1 is a view illustrating a common antenna.

As shown in FIG. 1, the antenna includes a reflector 100, phase shifters formed on one side of the reflector 100 and radiators 104 on the other side of the reflector 100.

The phase shifter 102 changes phase of a power (rf signal) supplied to the radiators 104, thereby adjusting angle of a beam outputted from the radiators 104, i.e. tilting angle.

Since three phase shifters 104 are generally connected to one phase shifter 102, five phase shifters 102 have been required for feeding a power to fifteen radiators 104, i.e. realizing fifteen ports. Accordingly, five phase shifters 102 should be disposed in series on the reflector 100, and thus size of the antenna increases.

The phase shifters 102 are individually controlled, and thus it is difficult and inconvenient to achieve desired tilting angle of the antenna.

SUMMARY

Example embodiment of the present invention provides a feeding system for reducing size of an antenna and usable easily and a feeding element included in the same.

A feeding system according to one embodiment of the present invention includes a first substrate; first patterns disposed on the first substrate; second patterns disposed on the first substrate, and connected electrically in parallel to the first patterns; a second substrate spaced from the first substrate; at least one third pattern disposed on the second substrate, and configured to correspond to the first patterns; and one or more fourth pattern disposed on the second substrate, and configured to correspond to the second patterns. Here, the third pattern connects electrically corresponding first patterns, and the fourth pattern connects electrically corresponding second patterns.

A feeding element according to one embodiment of the present invention includes a first substrate; first patterns disposed on the first substrate; and second patterns disposed on the first substrate, and connected electrically in parallel to the first patterns. Here, the first patterns are electrically connected each other by third patterns on a second substrate spaced from the first substrate, and the second patterns are electrically connected each other by fourth patterns on the second substrate.

A feeding system according to another embodiment of the present invention includes a first substrate; first patterns disposed on the first substrate; second patterns disposed on the first substrate, and connected electrically in parallel to the first patterns; a division system disposed on the first substrate, and configured to supply a power to the first patterns and the second patterns; a second substrate spaced from the first substrate; at least one third pattern disposed on the second substrate, and configured to correspond to the first patterns; and one or more fourth pattern disposed on the second substrate, and configured to correspond to the second patterns. Here, the first patterns and the second patterns are electrically connected to radiators through cables, respective cables have different lengths, and electrical lengths from outmost pattern of the first patterns to corresponding radiators and electrical lengths from outmost pattern of the second patterns to corresponding radiators have the same length.

A feeding system of the present invention may connect electrically first patterns disposed with for example U shape in pattern groups using third patterns, connect electrically second patterns using fourth patterns, and achieve multi port, e.g. fifteen ports by setting properly the number of the first patterns and the number of the second patterns. Here, the second patterns are disposed in parallel to the first patterns. For example, the present invention may supply a power one time to fifteen radiators by using one feeding system. Accordingly, size of an antenna employing the feeding system may reduce.

The present invention may realize the multi ports by controlling only one feeding system, and thus it is easy and convenient to use the feeding system. Especially, the present invention adjusts a tilting angle of the antenna by moving linearly only one of a first substrate and a second substrate, and so it is easy to control the feeding system.

Patterns are disposed with divided in pattern groups on the first substrate, and thus length of cables may reduce, the cable connecting electrically the patterns to radiators. As a result, the antenna may have an advantage in cost, complexity and view, etc.

The feeding system delays or divides the power inputted from an external source, and thus it may be variously used as a phase shifter, a power divider, a delay device, etc.

BRIEF DESCRIPTION OF DRAWINGS

Example embodiments of the present invention will become more apparent by describing in detail example embodiments of the present invention with reference to the accompanying drawings, in which.

DETAILED DESCRIPTION

Hereinafter, embodiments of the present invention will be described in detail with reference to accompanying drawings.

Figure 1:
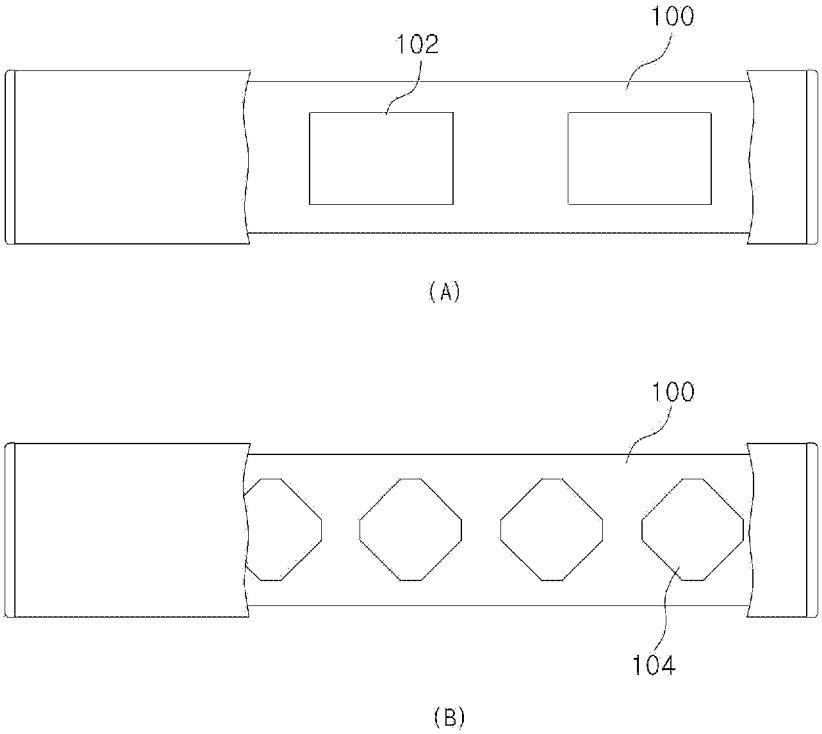
FIG. 1 is a view illustrating a common antenna.
Figure 2:
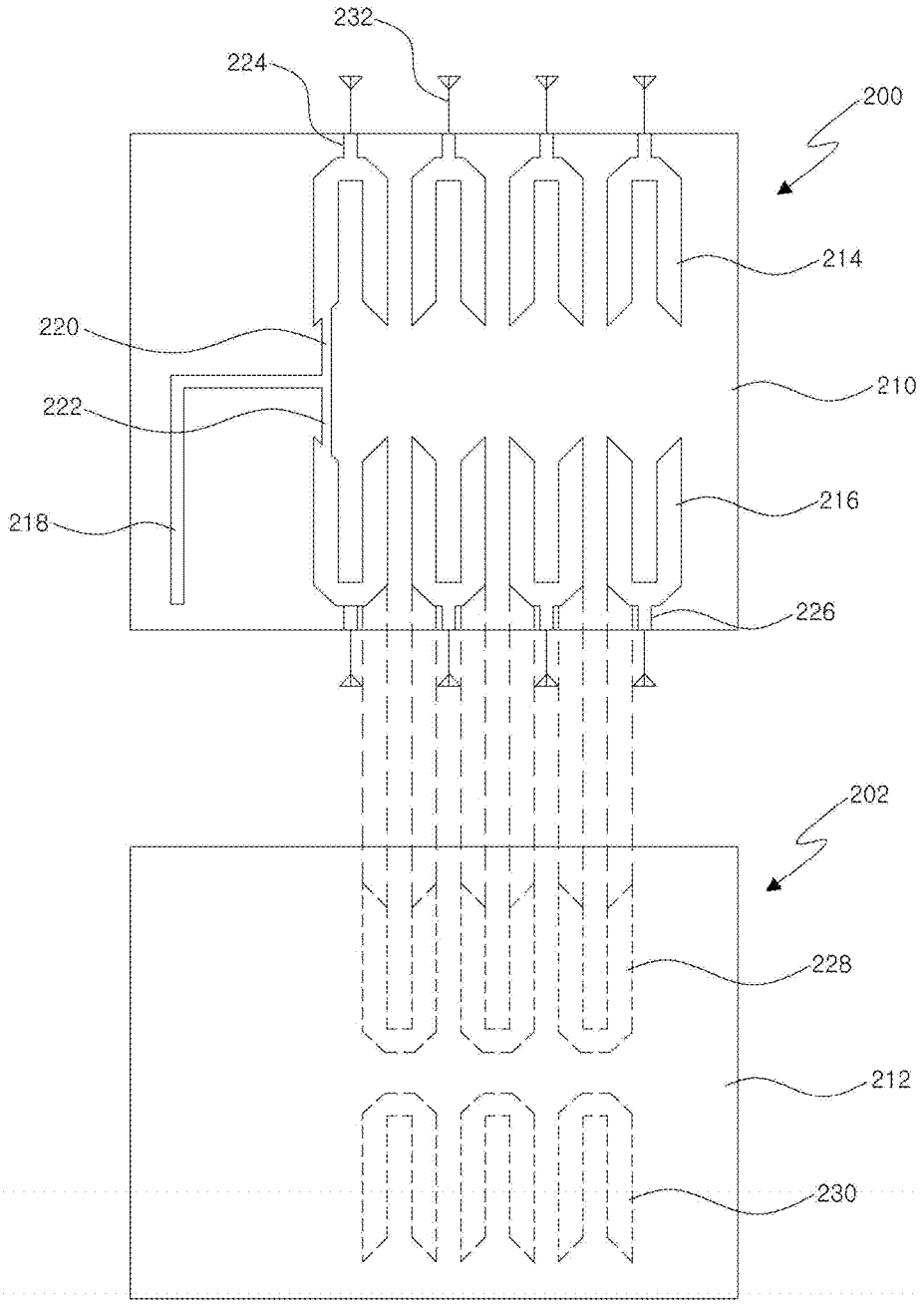
FIG. 2 is a view illustrating a feeding system according to a first embodiment of the present invention.
Figure 3:
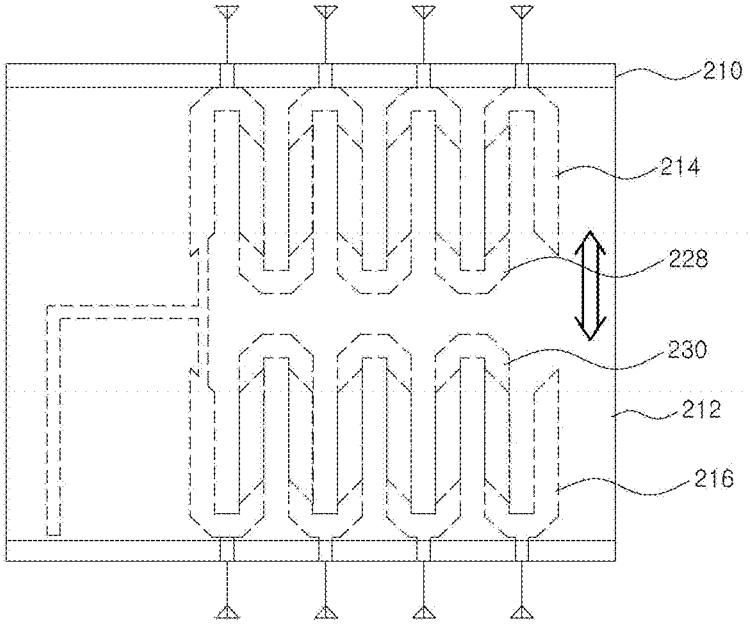
FIG. 3 is a view illustrating operation of the feeding system in FIG. 2.

FIG. 2 is a view illustrating a feeding system according to a first embodiment of the present invention, and FIG. 3 is a view illustrating operation of the feeding system in FIG. 2.

The feeding system of the present embodiment means every device for dividing a power inputted from an external source or delivering the power to another device through its output terminal, and may be for example a phase shifter, a power divider, a delay device, etc.

Hereinafter, structure and operation of the feeding system will be described in detail with reference to the phase shifter as the feeding system.

In FIG. 2, the feeding system may include a first feeding element 200 and a second feeding element 202 separated with each other.

The first feeding element 200 may include a first dielectric substrate 210, at least one first pattern 214, one or more second pattern 216, an input pattern 218, division patterns 220 and 222, at least one fifth pattern 224 and one or more sixth pattern 226. The first feeding element 200 may further include first coupling prevention elements (not shown) for preventing coupling between the first patterns 214 and second coupling prevention elements (not shown) for preventing coupling between the second patterns 216. The coupling prevention elements may be conductors.

The second feeding element 202 may include a second dielectric substrate 212, at least one third pattern 228 and one or more fourth pattern 230.

The first dielectric substrate 210 is disposed on one side of for example a reflector (not shown), and is made up of dielectric material having certain dielectric constant. A ground plate may be formed on a rear side of the first dielectric substrate 210 as described later.

The first pattern 214 is a conductor, and is formed on the first dielectric substrate 210. In one embodiment of the present invention, the first pattern 214 may have reverse U shape as shown in FIG. 2. However, the first pattern 214 may be shown to have U shape according to viewpoint. Here, U shape means a shape including a left pattern, a middle pattern and a right pattern as described later.

In FIG. 2, the first patterns 214 have substantially the same shape and size. However, some of the first patterns 214 may have different shape or size.

The second pattern 216 is a conductor, and is disposed on the first dielectric substrate 210 with faced with the first pattern 214 as shown in FIG. 2. In one embodiment of the present invention, the second pattern 216 may have U shape. That is, the patterns 214 and 216 may have substantially the same shape and face each other.

In FIG. 2, the second patterns 216 have substantially the same shape and size. However, some of the second patterns 216 may have different shape or size.

The input pattern 218 means a pattern to which the power is supplied from an external source. For example, an internal conductor of a cable (not shown) for delivering the power may be electrically connected to an end part of the input pattern 218.

The division patterns 220 and 222 are electrically connected to the input pattern 218, the first pattern 214 and the second pattern 216 as shown in FIG. 2, and deliver the power supplied through the input pattern 218 to the first pattern 214 and the second pattern 216.

In FIG. 2, the division patterns 220 and 222 are electrically connected to leftmost pattern of the first patterns 214 and leftmost pattern of the second patterns 216. However, the division patterns 220 and 222 may be electrically connected to other patterns, e.g. 214 and 216.

The division patterns 220 and 222 are directly connected to the patterns 214 and 216, but they may be electrically connected to the patterns 214 and 216 through a coupling method.

The fifth pattern 224 is a conductor, is formed on the first dielectric substrate 210, and connects electrically corresponding first pattern 214 to corresponding radiator 232. As a result, the power inputted through the first patterns 214 is delivered to the radiators 232 through the fifth patterns 224, and thus the radiators 232 generate a beam in specified direction.

The sixth pattern 226 is a conductor, is formed on the first dielectric substrate 210, and connects electrically corresponding second pattern 216 to corresponding radiator 232. As a result, the power inputted through the second patterns 216 is delivered to the radiators 232 through the sixth patterns 226, and thus the radiators 232 generate a beam in specified direction.

In one embodiment of the present invention, some of phases of the power (RF signals) traversing through the fifth patterns 224 and the sixth patterns 226 may differ. It is desirable that the phases are changed with specified rule as described later.

In an embodiment of the present invention, at least one of the fifth patterns 224 and the sixth patterns 226 may have different impedance from the other patterns 224 and 226. For example, one or more the patterns 224 and 226 may have different size (width or length) from the other patterns 224 and 226. Accordingly, the power supplied to respective radiators 232 may differ. The impedance or size of the patterns 224 and 226 may be determined according to characteristics of desired beam.

The second dielectric substrate 212 is formed with dielectric material having specified dielectric constant, and may have substantially the same dielectric constant as the first dielectric substrate 210 or have different dielectric constant from the first dielectric substrate 210.

The third patterns 228 are conductors, and are formed on the second dielectric substrate 212, e.g. in regular. In one embodiment of the present invention, the third pattern 228 may have U shape as shown in FIG. 2.

The third patterns 228 connect electrically the first patterns 214 with each other.

The fourth patterns 230 are conductors, and face the third patterns 228 on the second dielectric substrate 212. In one embodiment of the present invention, the fourth pattern 230 may have reverse U shape as shown in FIG. 2.

The fourth patterns 230 connect electrically the second patterns 216 with each other.

Structure of the patterns 228 and 230 may be variously modified as long as the third patterns 228 and the fourth patterns 230 connect electrically the first patterns 214 and the second patterns 216, respectively.

Operation of the feeding elements 200 and 202 is as follows. The second feeding element 202 locates on the first feeding element 200 with spaced from the first feeding element 200 as shown in FIG. 3, and moves for example linearly as shown in FIG. 3 while changing the phase. In another embodiment, the first feeding element 200 may move under the condition of fixing the second feeding element 202. Additionally, the feeding element 200 or 202 may move nonlinearly, e.g. along curve. In this case, the patterns in the feeding elements 200 and 202 may have curve shapes.

In brief, the feeding system of the present embodiment connects electrically the first patterns 214 on the first dielectric substrate 210 by using the third patterns 228 on the second dielectric substrate 212, and connects electrically the second patterns 216 by using the fourth patterns 230 on the second dielectric substrate 212. Particularly, the first pattern 214 and the second pattern 216 are disposed in parallel on the first dielectric substrate 210.

Hereinafter, the disposition of the patterns disposed in parallel will be referred to as pattern group. The feeding system in FIG. 2 divides the patterns 214 and 216 in two pattern groups.

However, the patterns 214 and 216 may be disposed in three pattern groups. In this case, structure of the input pattern and the division patterns may be modified, the input pattern and the division patterns achieving one division system.

That is, the feeding system of the present invention has two or more pattern groups. However, the feeding system may have one pattern group. It is desirable to realize two or more pattern groups in consideration of length of the cable as described later.

Hereinafter, the feeding system having one pattern group and the feeding system having two pattern groups will be compared.

Figure 4:
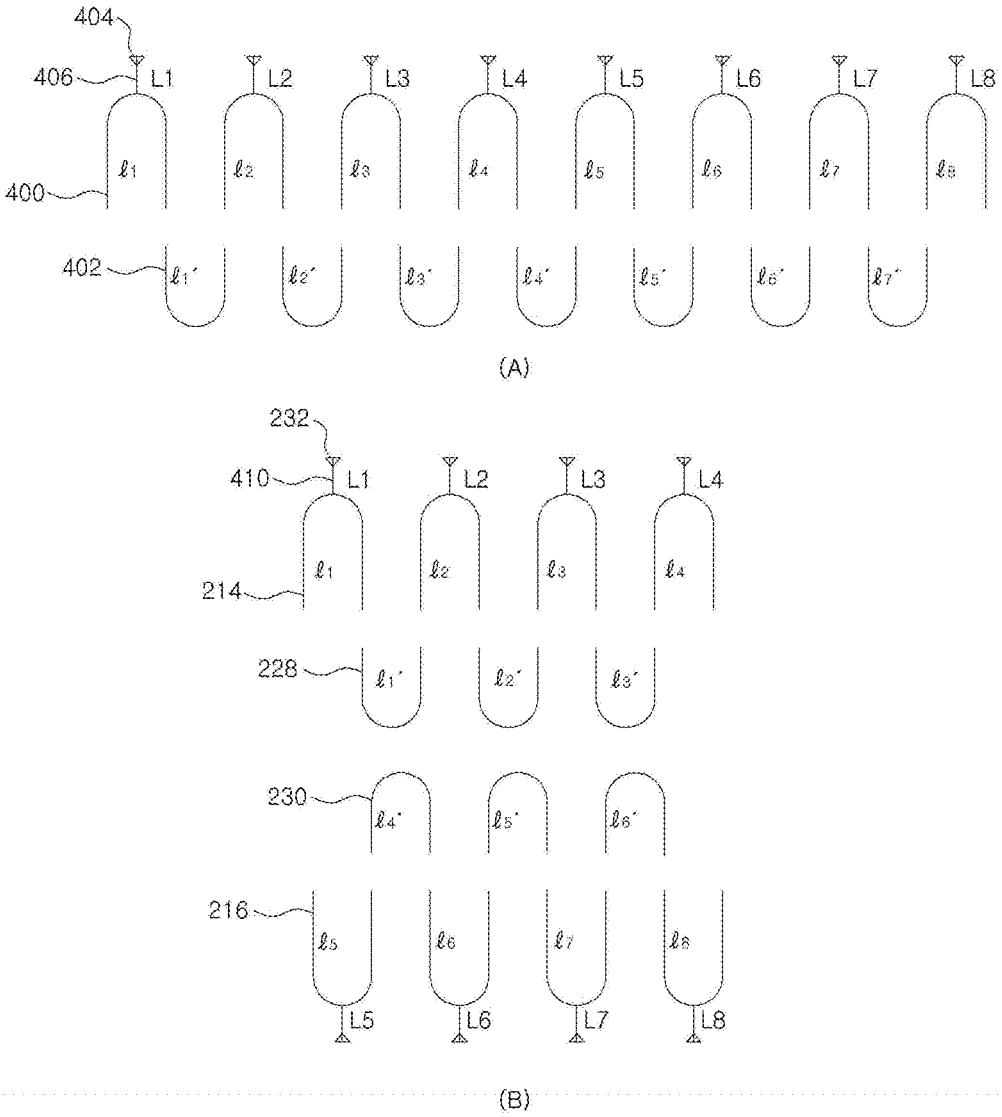
FIG. 4 is a view illustrating patterns in one pattern group and patterns in two pattern groups according to one embodiment of the present invention.

FIG. 4 is a view illustrating patterns in one pattern group and patterns in two pattern groups according to one embodiment of the present invention. Particularly, (A) in FIG. 4 shows one pattern group, and (B) in FIG. 4 illustrate two pattern groups. It is assumed as the feeding system supplies the power to eighth radiators.

In (A) in FIG. 4, first patterns 400 are electrically connected each other by the second patterns 402. The first patterns 400 are electrically connected to radiators 404 through cables 406, and electrical lengths from leftmost pattern of the first patterns 400 to respective radiators 404 are set to have the same length in the initial of the feeding system. Particularly, electrical length from the leftmost first pattern 400-1 to a first radiator 404-1, electrical length from the first pattern 400-1 to a second radiator 404-2, electrical length from the first pattern 400-1 to a third radiator 404-3, electrical length from the first pattern 400-1 to a fourth radiator 404-4, electrical length from the first pattern 400-1 to a fifth radiator 404-5, electrical length from the first pattern 400-1 to a sixth radiator 404-6, electrical length from the first pattern 400-1 to a seventh radiator 404-7, and electrical length from the first pattern 400-1 to an eighth radiator 404-8 are set to have the same length.

As a result, the electrical length from the first pattern 400-1 to the first radiator 404-1, i.e. (11/2+L1) is substantially identical to the electrical length from the first pattern 400-1 to the eighth radiator 404-8, i.e. (11+11'+12+12'+13+13'+14+14'+15+15'+16+16'+17+17'+18/2+L8). Accordingly, length L1 of a first cable 406-1 should be considerably longer than that L8 of an eighth cable 406-8. Hence, L1>L2>L3>L4>L5>L6>L7>L8.

In (B) in FIG. 4, electrical length from the first pattern 214-1 to the first radiator 232-1, i.e. (11/2+L1) may be substantially identical to that from the first pattern 214-1 to the fourth radiator 232-4, i.e. (11+11'+12+12'+13+13'+14/2+L4), or that from the second pattern 216-1 to the eighth radiator 232-8, i.e. (15+15'+16+16'+17+17'+18/2+L8). Accordingly, length L1 of a first cable 410-1 is longer than that L4 of a fourth cable 410-4 or that L8 of an eighth cable 410-8.

However, the length of the first cable 410-1 corresponding to the leftmost first pattern 214 in the feeding system including the pattern groups as shown in (B) in FIG. 4 may be considerably shorter than that of the first cable 406-1 in the feeding system including only one pattern group as shown in (A) in FIG. 4.

That is, the length of the cable in the feeding system where the patterns are divided into the pattern groups on the first dielectric substrate 210 may be shorter than that of the cable in the feeding system including only one pattern group.

Hereinafter, effect of the feeding systems will be compared.

Since the length of the cable is long in the feeding system including one pattern group, cost for realizing the feeding system increases. In addition, the feeding system becomes complex and is not good in view, due to the cables.

Since the length of the cable is considerably short in the feeding system including the pattern groups, and thus cost for realizing the feeding system may reduce. Furthermore, the feeding system may reduce in complex and be advantage in view.

Size of the feeding system including the pattern groups may be smaller than that of the feeding system including one pattern group.

Hereinafter, a process of changing the phase through the phase shifter will be described in detail with reference to accompanying drawings.

Figure 5:
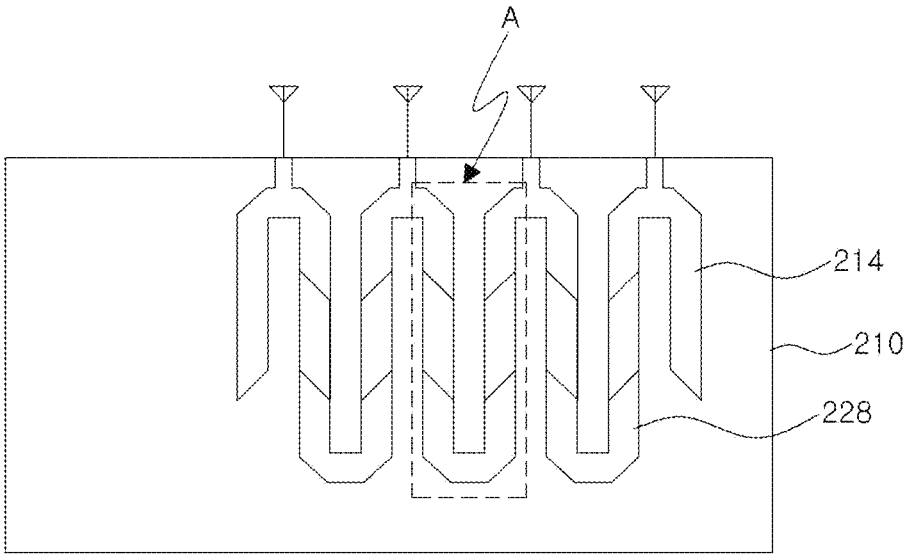
FIG. 5 is a view illustrating operation of a feeding system according to one embodiment of the present invention.
Figure 6:
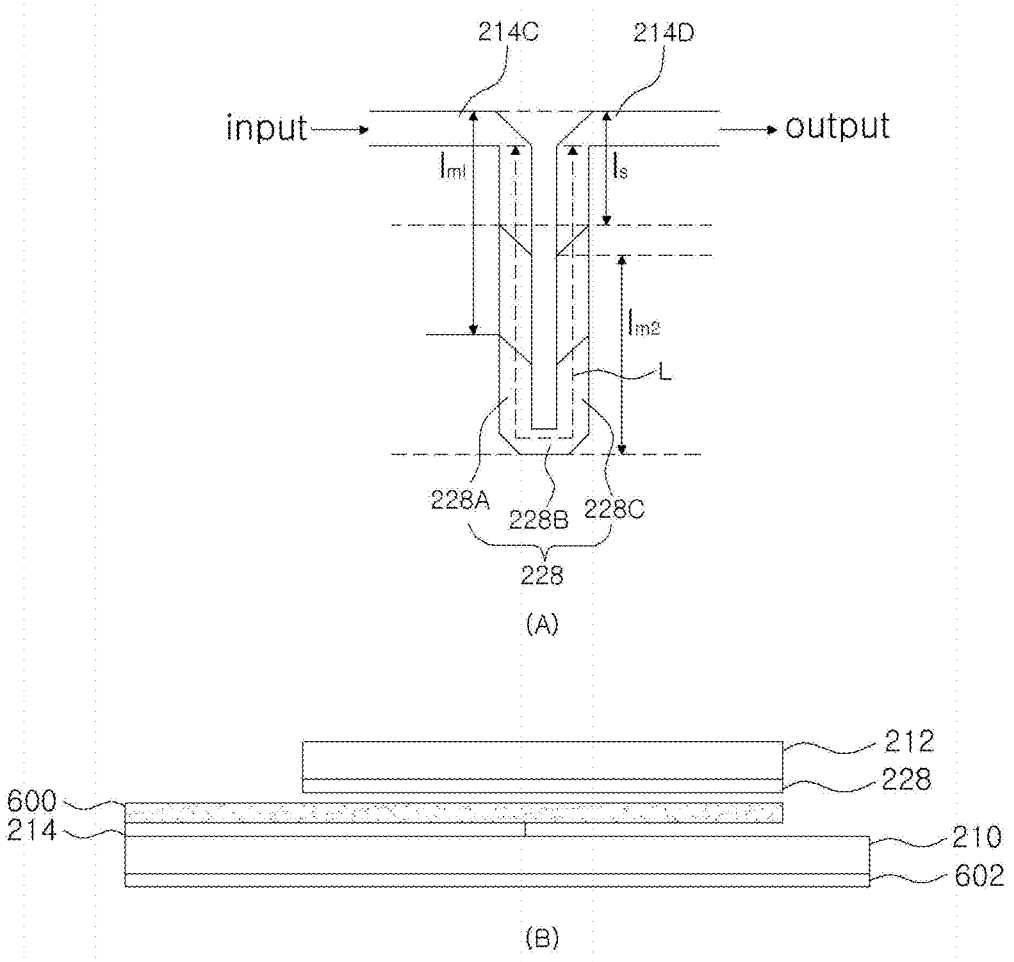
FIG. 6 is a view illustrating enlargedly "A" section in FIG. 5 according to one embodiment of the present invention.

FIG. 5 is a view illustrating operation of a feeding system according to one embodiment of the present invention, and FIG. 6 is a view illustrating enlargedly "A" section in FIG. 5 according to one embodiment of the present invention. For convenience of description, only first patterns 214 are shown on the first dielectric substrate 210, and only third patterns 228 are shown on the second dielectric substrate 212.

In the event that the second feeding element 202 locates on the first feeding element 200 as shown in FIG. 3, the first patterns 214 and the third patterns 228 are overlapped as shown in FIG. 5 and (A) in FIG. 5. Particularly, for example, a left pattern 228A of the third pattern 228 is overlapped with a right pattern of the first pattern 214C, and a right pattern 228C of the third pattern 228 is overlapped with a left pattern of a first pattern 214D. As a result, the first pattern 214C is electrically connected to the first pattern 220D through the third pattern 228. That is, the first patterns 214 are electrically connected each other through corresponding third pattern 228.

In view of power, a power inputted to the first pattern 214C is supplied to the first pattern 214D through the third pattern 228.

It is assumed that length of side pattern (right pattern or left pattern) of the first patterns 214C and 214D is $l_{m1}$ and length of side pattern (right pattern or left pattern) of the third pattern 228 is $l_{m2}$. In this case, the first pattern 214C or 214D and the third pattern 228 may be maximally overlapped by smaller value of $l_{m1}$ and $l_{m2}$. Generally, a part of the first pattern 214C or 214D and a part of the third pattern 228 are overlapped as shown in (A) in FIG. 6.

If length of a pattern not overlapped of the first pattern 214C or 214D is $l_s$ and $l_{m1}$ and $l_{m2}$ are the same length, $0 \le l_s << l_{m1}$.

Since the second feeding element 202 moves on the first feeding element 200 as described above, size of an area by which the first pattern 214C or 214D and the third pattern 228 are overlapped is changed. As a result, $l_s$ and electrical length L vary depending on the movement. Accordingly, phase $\phi$ of the power outputted to the first pattern 214D varies depending on $l_s$, i.e. the electrical length L as shown in following Equation 1.

$$\Delta\varphi = 2 \cdot \Delta l_s \cdot \frac{2\pi}{\lambda_g}, \qquad \text{[Equation 1]}$$

where $\lambda_g$ is wavelength of the RF signal.

Referring to Equation 1, the phase $\phi$ changes in proportion to length change of $l_s$. Here, the electrical length L changes in proportion to $l_s$.

(A) in FIG. 6 shows only one overlapped pattern of patterns in FIG. 4. In reality, (n−1)/2 overlapped patterns exist in n port feeding system including two pattern groups. In this case, total electrical length $l_T$ of the overlapped patterns is shown in following Equation 2.

$$\left(\frac{n-1}{2}\right) \cdot \frac{\lambda_{g,max}}{2} < l_T < \frac{n}{2} \cdot \frac{\lambda_{g,min}}{2}, \qquad \text{[Equation 2]}$$

$$n = 1, 2, 3, \ldots \text{ (정수)}$$

$$\lambda_g = \frac{c}{f} \cdot \frac{1}{\sqrt{\varepsilon_r}}$$

where $\lambda_{g,max}$ means the greatest wavelength in a bandwidth of the feeding system, $\lambda_{g,min}$ indicates the smallest wavelength in the bandwidth, and $\in_r$ is dielectric constant of the first dielectric substrate 210.

Referring to Equation 2, the total electrical length $l_T$ of the overlapped patterns changes according to wavelength corresponding to the number of ports and bandwidth.

In another view, a power (RF signal) outputted to the first pattern 214D is delayed in the event that the electrical length L increases according as the second feeding element 202 moves in the downward direction as shown in FIG. 3. The structure shown in FIG. 6(A) corresponds to a part of the feeding system, but may function as a delay device in itself. Namely, the feeding system of the present embodiment may operate as the delay device through the method of overlapping the first patterns 214 and the third patterns 228. Here, the delay degree may vary depending on the number of the patterns 214 and 228 and the length of the overlapped part of the patterns.

Hereinafter, sectional view of the structure shown in (B) in FIG. 6 will be described.

As shown in (B) in FIG. 6, the first pattern 214 is formed on the first dielectric substrate 210, and the third pattern 228 is formed on the second dielectric substrate 212. Additionally, a ground plate 602 is formed on a rear surface of the first dielectric substrate 210.

In one embodiment of the present invention, a dielectric layer 600 having certain dielectric constant exists between the first pattern 214 and the third pattern 228. For example, the dielectric layer 600 is formed on the first patterns 214, and is used for reducing the passive intermodulation distortion (PIMD) and preventing corrosion.

The second patterns 216 and the fourth patterns 230 operate in the similar manner to the first patterns 214 and the third patterns 228, which is not described. A dielectric layer may exist between the second patterns 216 and the fourth patterns 230.

Figure 7:
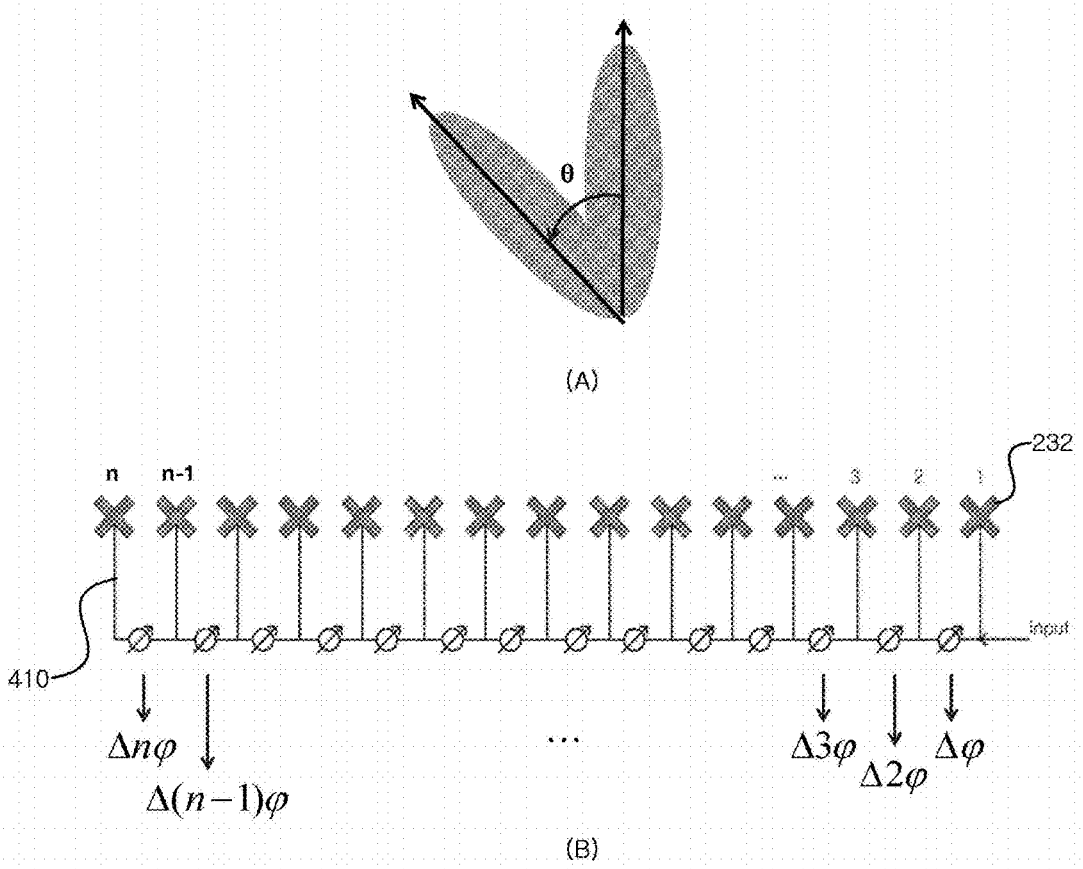
FIG. 7 and FIG. 8 are views illustrating a process of controlling phase by the feeding system according to one embodiment of the present invention.
Figure 8:
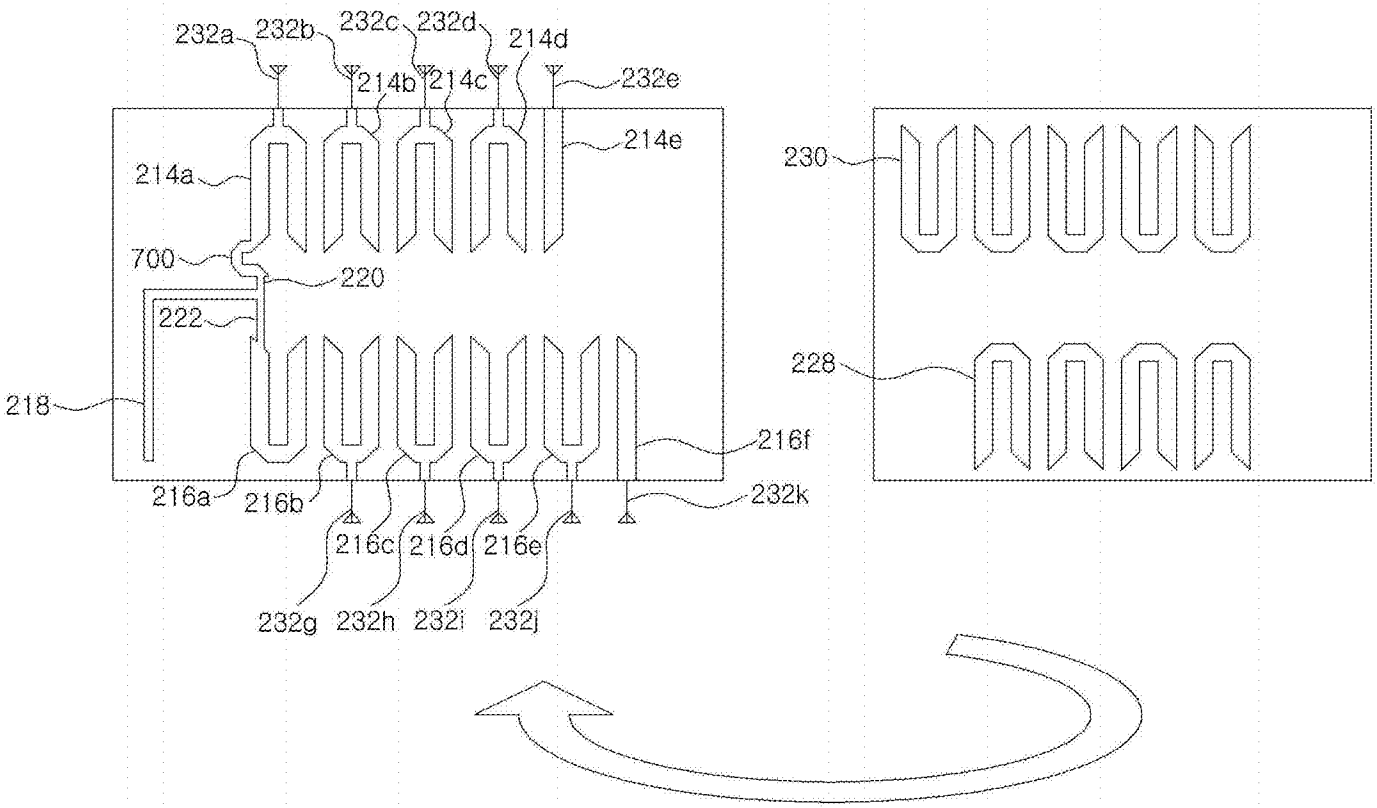

FIG. 7 and FIG. 8 are views illustrating a process of controlling phase by the feeding system according to one embodiment of the present invention.

In FIG. 7, n (integer of above 2) first patterns 214 and the second patterns 216 are formed on the first dielectric substrate 210, and the patterns 214 and 216 may be electrically connected to n radiators 232 through the cables 410.

If overlap areas of the patterns 214 and 216 and the patterns 228 and 230 change constantly in response to moving of the second feeding element, a part of a power inputted to an input terminal (front pattern of the first patterns, 214-1) is supplied to the first radiator 232-1 through corresponding fifth pattern 224-1 without change of phase, and the other power is delivered to next first pattern 214-2. A part of the power delivered to the first pattern 214-2 is supplied with phase changed, by $\Delta\phi$ corresponding to change 2 Δ 1 of the overlapped area of the patterns 214 and 228, to a second radiator 232-2 through a fifth pattern 224-2, and the other power is delivered to next first pattern 214-3. A part of the power delivered to the first pattern 214-3 is supplied, with phase changed by $\Delta 2\phi$ corresponding to accumulated change 4 Δ 1 of the overlapped area of the patterns 214 and 228, to a second radiator 232-3 through a fifth pattern 224-3, and the other power is delivered to next first pattern 214-4.

Phase in accordance with change of overlap area of the second patterns 216 and the fourth patterns 230 may be changed in the similar manner to the above phase change.

That is, RF signals having phase changed in sequence by $\Delta\phi, \Delta 2\phi, \ldots, \Delta n\phi$ are inputted to the radiators 232 as shown in (B) in FIG. 7, and so the tilting angle of the beam may be adjusted by $\theta$ as shown in (A) in FIG. 7.

In the present invention, in the event that the power is supplied to for example ten radiators 232 as shown in FIG. 8, phases of the RF signals transmitted to each of a first radiator 232*a*, a second radiator 232*b*, a third radiator 232*c*, a fourth radiator 232*d* and a fifth radiator 232*e*, have and $-\Delta\phi$, $-\Delta 2\phi$, $-\Delta 3\phi$, $-\Delta 4\phi$ and $-\Delta 5\phi$, respectively. Phases of the RF signals transmitted to each of a sixth radiator 232*g*, a seventh radiator 232*h*, an eighth radiator 232*i*, a ninth radiator 232*j* and a tenth radiator 232*k*, have $\Delta\phi$, $\Delta 2\phi$, $\Delta 3\phi$, $\Delta 4\phi$ and $\Delta 5\phi$, respectively.

Accordingly, the phases of the RF signals inputted to the radiators 232 may have $\Delta\phi$, $\Delta 2\phi$, $\Delta 3\phi$, $\Delta 4\phi$, $\Delta 5\phi$, $\Delta\phi$, $\Delta 2\phi$, $\Delta 3\phi$, $\Delta 4\phi$ and $\Delta 5\phi$, respectively.

Now referring to FIG. 8, the feeding system may delay the phases of the RF signals by $\Delta\phi$ using patterns 700 and 216*a*, because phase difference between the radiators 232*a* and 232*g* is $\Delta 2\phi$.

Rightmost pattern 214*e* of the first patterns 214 and rightmost pattern 214*f* of the second patterns 216 may have rod shape not U shape. This is because the power need not to be delivered in the right direction.

In brief, the feeding system of the present embodiment may achieve desired tilting angle by controlling electrical length of overlap area of the first patterns 214 and the third patterns 228 and electrical length of overlap area of the second patterns 216 and the fourth patterns 230.

In the conventional antenna, many feeding systems are required for achieving multi ports, i.e. providing the power to the radiators. However, since the present invention may realize multi ports by increasing the number of the patterns 214 and 216 in one feeding system, size of the antenna may reduce. Especially, since the feeding system uses the pattern groups, the size of the antenna may more reduce.

The length of corresponding cable may reduce if the patterns are divided into the pattern groups, and thus it is advantage in cost and view, etc.

The conventional antenna controls individually the phase shifters to adjust the tilting angle. However, the feeding system of the present invention may adjust the tiling angle through simple operation of moving the second feeding system 202, and thus it is convenient to use the feeding system.

The feeding system of the present invention uses as the phase shifter, but may use also as the delay device, etc. In other words, the feeding system may be variously utilized.

Figure 9:
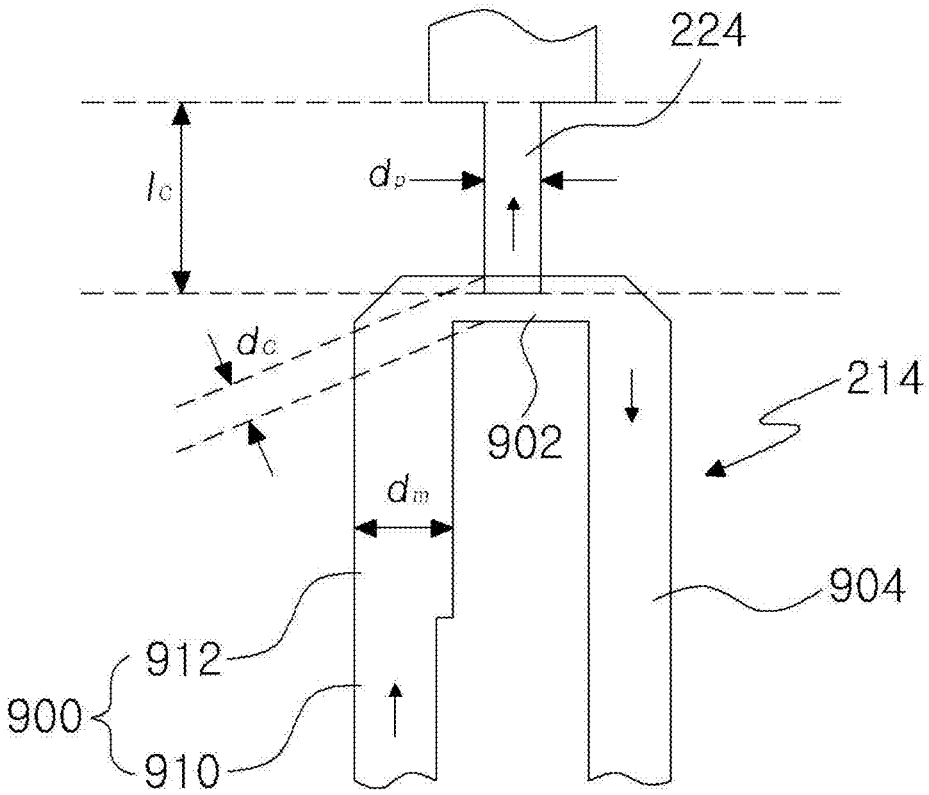
FIG. 9 is a view illustrating the first pattern or the second pattern according to one embodiment of the present invention.

FIG. 9 is a view illustrating the first pattern or the second pattern according to one embodiment of the present invention. FIG. 9 shows only the first pattern 214 for convenience of description.

As shown in FIG. 9, the first pattern 214 includes a left pattern 900, a middle pattern 902 and a right pattern 904, and a power is inputted to an input pattern 910 of the left pattern 900.

Subsequently, the power inputted into the input pattern 910 flows through a matching pattern 912 of the left pattern 900, and then the power is divided into the right pattern 904 and the fifth pattern 224 at the middle pattern 902. In this time, the division of the power is affected by thickness $h_c$ of a dielectric layer (not shown) located between the first pattern 224 and the fifth pattern 224, width $d_p$ of the fifth pattern 224, length $l_c$ of the fifth pattern 224 and width $d_c$ of the middle pattern 902.

Since it is important to minimize loss of the power while delivering the power, the feeding system of the present invention considers impedance matching.

Now referring to FIG. 9, the matching pattern 912 of the left pattern 900 and the middle pattern 902 perform impedance matching when the power is delivered from the left pattern 900 of the first pattern 214 to the fifth pattern 224. Particularly, the impedance matching may be achieved by controlling width $d_m$ of the matching pattern 912 and the width $d_c$ of the middle pattern 902. Here, the width $d_c$ of the middle pattern 902 corresponds to inductive component for adjusting capacitance in accordance with the thickness $h_c$ of the dielectric layer. In one embodiment of the present invention, the width $d_m$ of the matching pattern 912 may be higher than that of the input pattern 910.

In impedance matching when the power is delivered from the left pattern 900 of the first pattern 214 to the right pattern 904, the matching pattern 912 of the left pattern 900 and the middle pattern 902 performs impedance matching. In one embodiment of the present invention, the width $d_m$ of the matching pattern 912 is higher than that of the input pattern 910, and the input pattern 910 may have substantially the same width as the right pattern 904.

In other words, the impedance matching is mainly affected by the width $d_m$ of the matching pattern 912 and the width $d_c$ of the middle pattern 902. Here, since the power delivered to the fifth patterns 224 may differ, the widths $d_m$ of the matching patterns 912 of the first patterns 214 may be different. Consequently, some of the first patterns 214 may have different shape, e.g. width $d_m$ from the other first patterns.

The second pattern 216 may have a structure similar to the first pattern 214, which is not shown.

Figure 10:
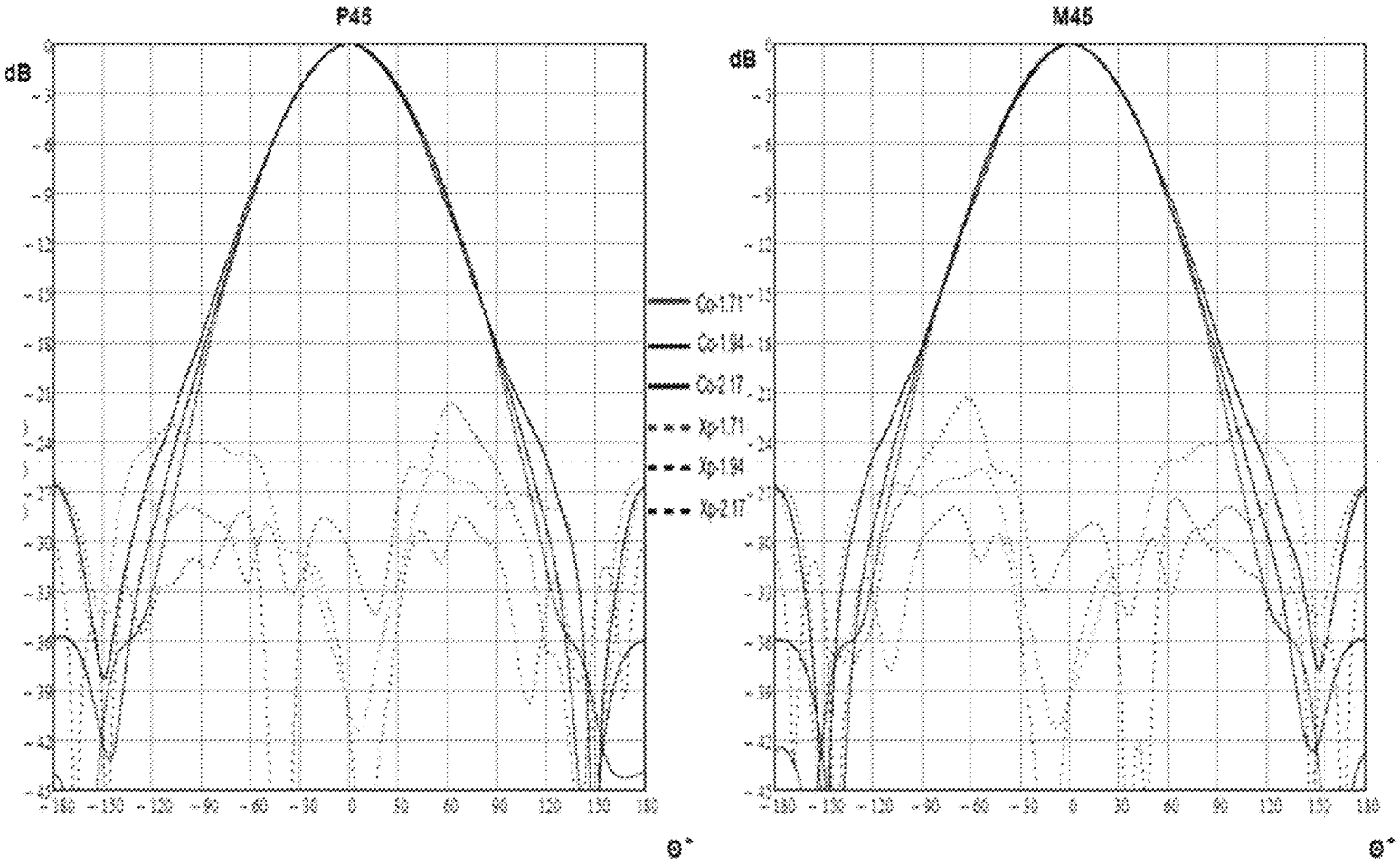
FIG. 10 is a view illustrating a radiation pattern of an antenna using the feeding system of the present invention.

FIG. 10 is a view illustrating a radiation pattern of an antenna using the feeding system of the present invention.

In FIG. 10, minor lobe of the antenna using the feeding system of the present invention has magnitude of below −20 dB. The antenna using conventional phase shifter has magnitude considerably higher than −20 dB. That is, it is verified through FIG. 10 that characteristics of the antenna of the present invention is excellent than those of the convention antenna.

Figure 11:
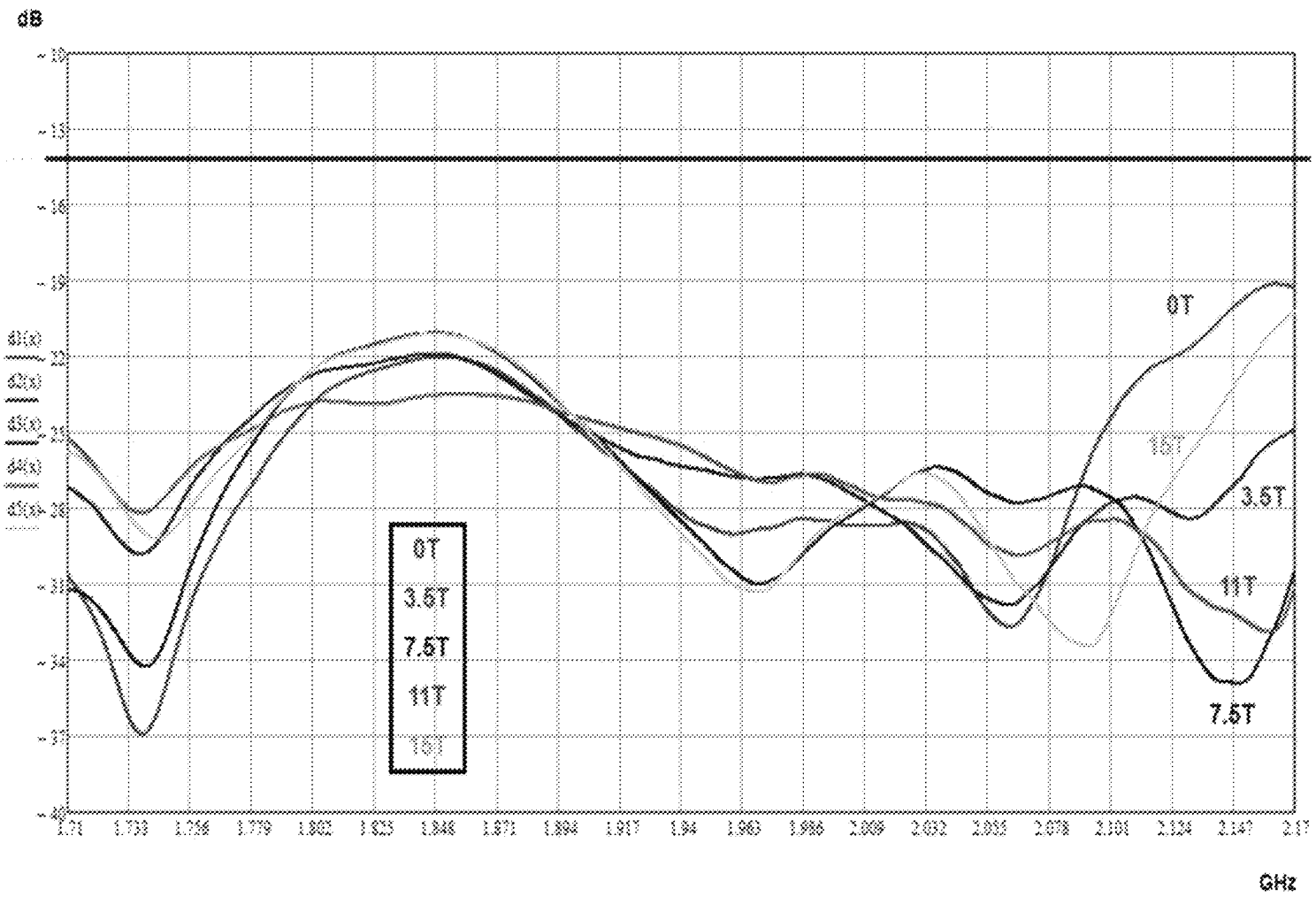
FIG. 11 is a view illustrating return loss according to the tilting angle in the antenna using the feeding system of the present invention.

FIG. 11 is a view illustrating return loss according to the tilting angle in the antenna using the feeding system of the present invention. A radiation pattern in FIG. 10 is a pattern measured between 1.71 GHz and 2.17 GHz, and is measured with changing the tilting angle from 0° to 15°.

Referring to FIG. 11, it is verified that the return loss of the antenna using the feeding system of the present invention maintains a value below −14 dB (usable reference value) though the tilting angle is changed by for example five times. That is, the antenna may have excellent return loss.

Figure 12:
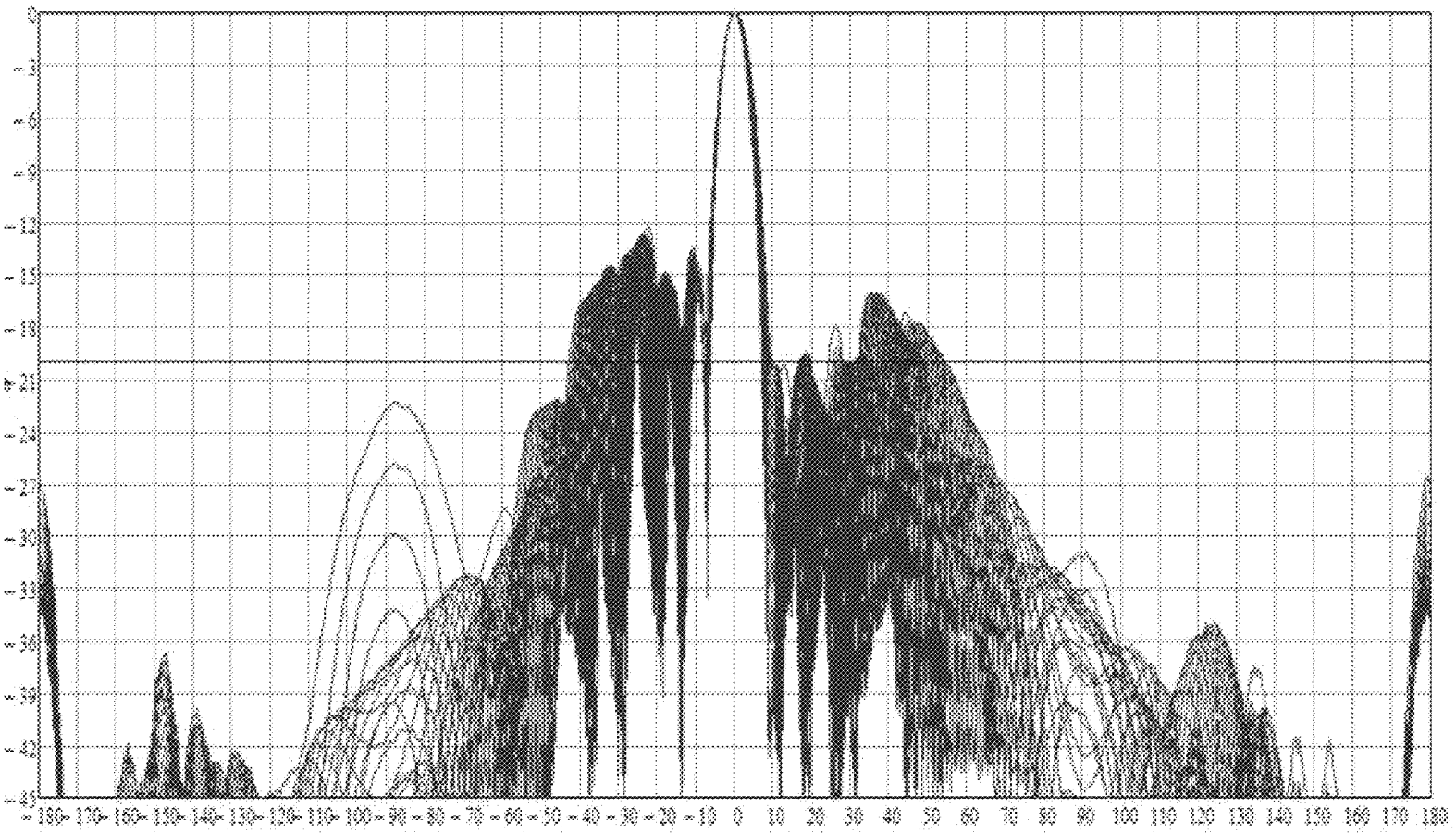
FIG. 12 is a view illustrating a radiation pattern at the tilting angle 0° in the antenna using the feeding system of the present invention.
Figure 13:
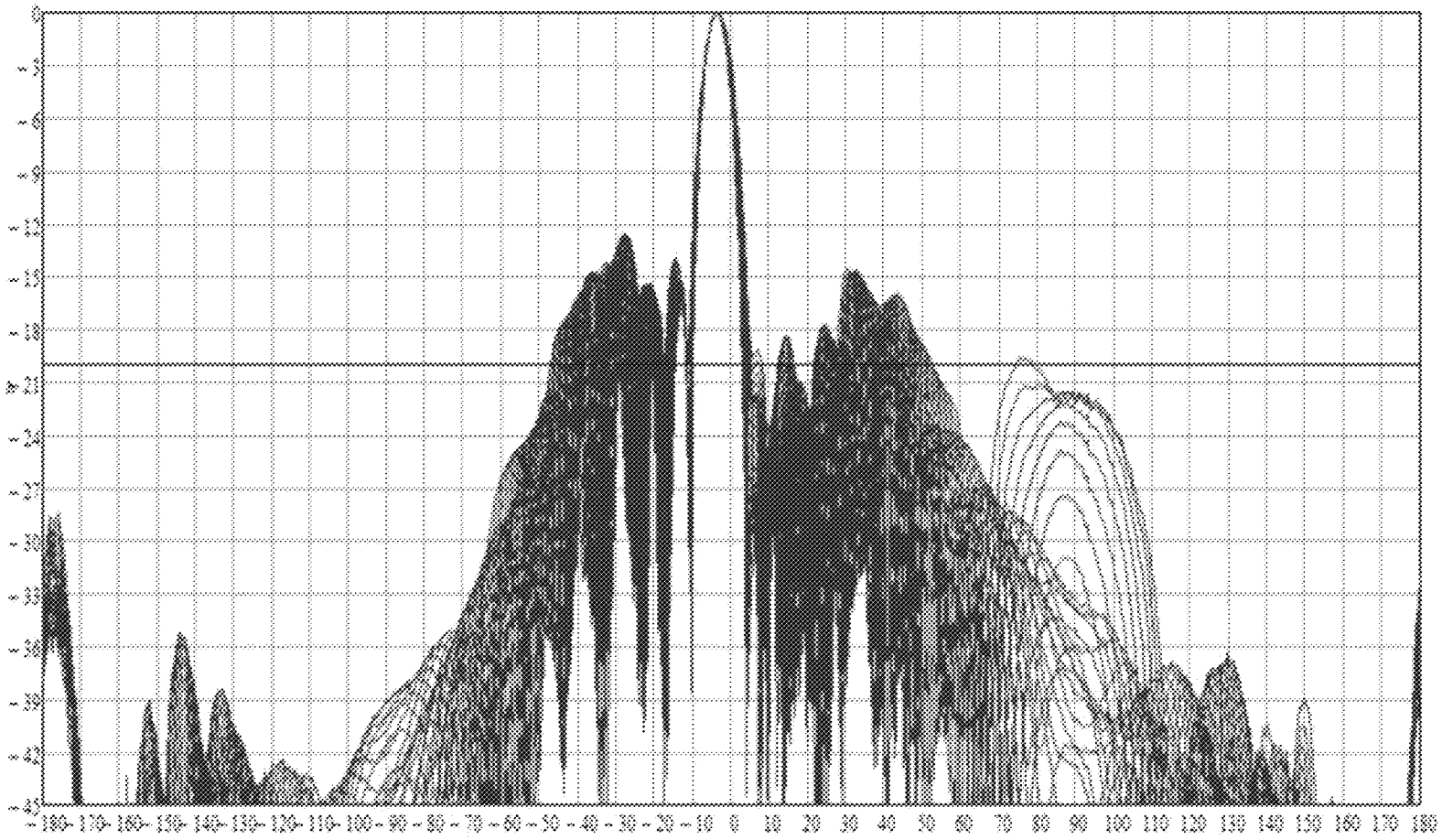
FIG. 13 is a view illustrating a radiation pattern at the tilting angle 35° in the antenna.
Figure 14:
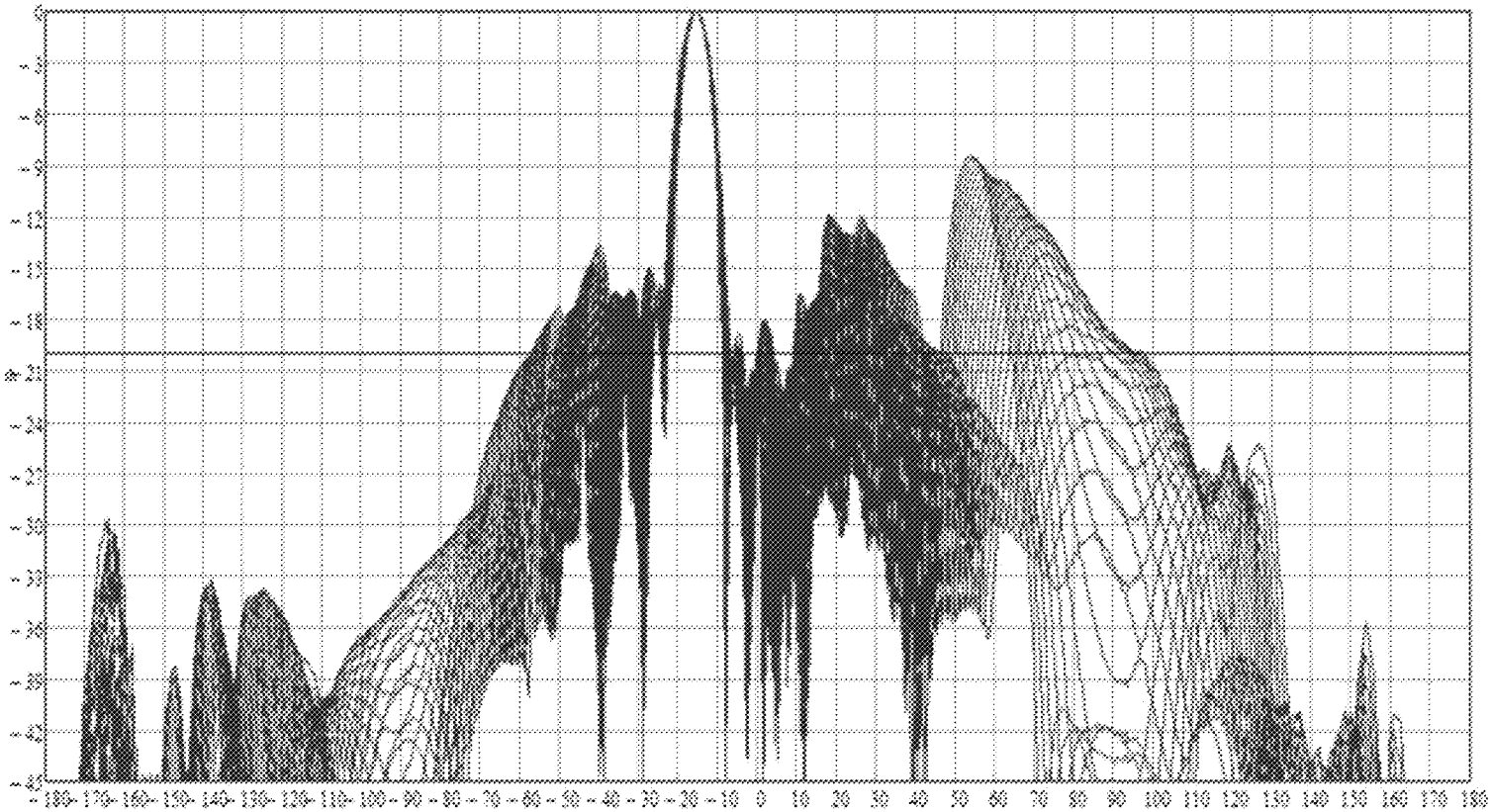
FIG. 14 is a view illustrating a radiation pattern at the tilting angle 15° in the antenna.

FIG. 12 is a view illustrating a radiation pattern at the tilting angle 0° in the antenna using the feeding system of the present invention, and FIG. 13 is a view illustrating a radiation pattern at the tilting angle 35° in the antenna. FIG. 14 is a view illustrating a radiation pattern at the tilting angle 15° in the antenna.

In FIG. 12 to FIG. 14, it is measured that magnitude of minor lobe has a value below −20 dB at desired range of the tilting angle, e.g. −10° to 10°. It is verified that the antenna may output the radiation pattern in desired direction.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A feeding system comprising:

a first substrate;

first patterns disposed on the first substrate;

second patterns disposed on the first substrate, and connected electrically in parallel to the first patterns;

a second substrate spaced from the first substrate;

at least one third pattern disposed on the second substrate, and configured to correspond to the first patterns; and one or more fourth pattern disposed on the second substrate, and configured to correspond to the second patterns, wherein the third pattern connects electrically corresponding first patterns, and the fourth pattern connects electrically corresponding second patterns, the first substrate or the second substrate moves while changing phase of an RF signal provided to a radiator, a part of the first pattern overlaps with a part of the third pattern, and electrical length of overlap area of the first pattern and the third pattern varies while changing the phase.

2. The feeding system of claim 1, wherein at least one of the first patterns has reverse U shape, one or more of the second patterns has U shape, the third pattern connects electrically a right pattern of specified first pattern to a left pattern of a first pattern adjacent to the specified first pattern, and the fourth pattern connects electrically a right pattern of specified second pattern to a left pattern of a second pattern adjacent to the specified second pattern.

3. The feeding system of claim 1, further comprising:

an input pattern disposed on the first substrate;

a first division pattern divided from the input pattern, and connected electrically to one of the first patterns; and a second division pattern divided from the input pattern, and connected electrically to one of the second patterns.

4. The feeding system of claim 1, further comprising:

a division system disposed on the first substrate, and configured to supply a power to the first patterns and the second patterns.

5. The feeding system of claim 1, wherein at least one of the first patterns has reverse U shape, and one or more of the second patterns has U shape, and wherein size of a left pattern of specified first pattern is different from size of a right pattern of the specified first pattern, size of a left pattern of specified second pattern is different from size of a right pattern of the specified second pattern, each of the first patterns and the second patterns is electrically connected to corresponding radiator, and RF signals supplied to the radiators have phases in sequence.

6. The feeding system of claim 1, wherein at least one of the first patterns have reverse U shape, and width of a part of a left pattern or a right pattern of specified first pattern is different from width of the other part of the left pattern or the right pattern.

7. The feeding system of claim 1, further comprising:

fifth patterns disposed on the first substrate, and configured to connect the first patterns to corresponding radiators, wherein size of some of the fifth patterns is different from size of the other fifth patterns, some of the first patterns is directly connected to corresponding fifth patterns, and the other first patterns are electrically connected to corresponding fifth patterns through an electrical coupling method.

8. The feeding system of claim 1, wherein the first patterns and the second patterns are electrically connected to radiators through corresponding cables, and wherein respective cables have different lengths, and electrical lengths from outmost pattern of the first patterns to corresponding radiators and electrical lengths from outmost pattern of the second patterns to corresponding radiators have the same length.

9. A feeding element comprising:

a first substrate;

first patterns disposed on the first substrate; and second patterns disposed on the first substrate, and connected electrically in parallel to the first patterns, wherein the first patterns are electrically connected to each other by third patterns on a second substrate spaced from the first substrate, and the second patterns are electrically connected to each other by fourth patterns on the second substrate, and electrical length of overlap area of the first patterns and the third patterns changes while changing phase of an RE signal provided to a radiator.

10. The feeding element of claim 9, wherein at least one of the first patterns have reverse U shape, and one or more of the second patterns have U shape, and wherein electrical length of overlap area of the second patterns and the fourth patterns changes while changing the phase.

11. The feeding element of claim 9, further comprising:

an input pattern disposed on the first substrate;

a first division pattern divided from the input pattern, and connected electrically to one of the first patterns; and a second division pattern divided from the input pattern, and connected electrically to one of the second patterns.

12. The feeding element of claim 9, wherein at least one of the first patterns has reverse U shape, and width of a part of a left pattern or a right pattern of specified first pattern is different from width of the other part of the left pattern or the right pattern.

13. The feeding element of claim 9, further comprising:

fifth patterns disposed on the first substrate, and configured to connect electrically the first patterns to corresponding radiators, wherein size of some of the fifth patterns is different from size of the other fifth patterns.

14. A feeding system comprising:

a first substrate;

first patterns disposed on the first substrate;

second patterns disposed on the first substrate, and connected electrically in parallel to the first patterns;

a division system disposed on the first substrate, and configured to supply a power to the first patterns and the second patterns;

a second substrate spaced from the first substrate;

at least one third pattern disposed on the second substrate, and configured to correspond to the first patterns; and one or more fourth pattern disposed on the second substrate, and configured to correspond to the second patterns, wherein the first patterns and the second patterns are electrically connected to radiators through cables, respective cables have different lengths, and electrical lengths from outmost pattern of the first patterns to corresponding radiators and electrical lengths from outmost pattern of the second patterns to corresponding radiators have the same length.

* * * * *